US006901838B2

(12) United States Patent
Dieling et al.

(10) Patent No.: US 6,901,838 B2
(45) Date of Patent: Jun. 7, 2005

(54) APPARATUS FOR ADAPTING A CONTAINER CONTAINING ARTILLERY ROCKETS TO A LAUNCHER APPARATUS FOR ARTILLERY ROCKETS

(75) Inventors: Frank Dieling, Ahnatal (DE); Rüdiger Baus, Neufahm (DE)

(73) Assignee: Krauss-Maffei Wegmann GmbH & Co. KG (DE)

( * ) Notice: Subject to any disclaimer, the term of this patent is extended or adjusted under 35 U.S.C. 154(b) by 0 days.

(21) Appl. No.: 10/669,023

(22) Filed: Sep. 23, 2003

(65) Prior Publication Data

US 2004/0134338 A1 Jul. 15, 2004

(30) Foreign Application Priority Data

Sep. 23, 2002 (DE) ..... 202 14 679 U

(51) Int. Cl.[7] ..... F41F 3/04
(52) U.S. Cl. ..... 89/1.804
(58) Field of Search ..... 89/1.801, 1.802, 89/1.804, 1.805, 1.815; 52/511

(56) References Cited

U.S. PATENT DOCUMENTS

| | | | | |
|---|---|---|---|---|
| 3,357,305 A | | 12/1967 | Clutz et al. | |
| 4,221,515 A | * | 9/1980 | Brown et al. | 410/32 |
| 4,604,939 A | | 8/1986 | Hoffmeiser et al. | |
| 4,666,035 A | * | 5/1987 | Johnson | 206/3 |
| 4,925,226 A | * | 5/1990 | Leonard et al. | 294/82.1 |
| 5,137,115 A | * | 8/1992 | Arnold | 182/142 |
| 5,144,786 A | * | 9/1992 | Pacione | 52/747.1 |
| 5,212,924 A | * | 5/1993 | Finkelstein | 52/582.2 |
| 5,377,577 A | * | 1/1995 | Bounkong et al. | 89/36.05 |
| 5,461,961 A | | 10/1995 | Baus et al. | |
| 6,250,490 B1 | * | 6/2001 | Loftus | 220/23.4 |
| 6,626,625 B2 | * | 9/2003 | Nelson et al. | 410/130 |

FOREIGN PATENT DOCUMENTS

DE 100 45 051 3/2002

* cited by examiner

*Primary Examiner*—Michael Carone
*Assistant Examiner*—Troy Chambers
(74) *Attorney, Agent, or Firm*—Robert W Becker & Associates; Robert W Becker

(57) ABSTRACT

An apparatus is provided for the adaptation of a container of artillery rockets to a launcher apparatus for such rockets. A box-like launcher frame is disposed on a support structure, especially a vehicle chassis, and is pivotable in elevation and azimuth. At least one container, which has a right-angled cross-section and contains a plurality of artillery rockets, is adapted to be inserted from one end into the launcher frame. At least one adjustment module in the form of an essentially rectangular flat panel is provided. For a container having outer dimensions smaller than inner dimensions of the launcher frame, the adjustment module is disposable on the upper side and/or the underside of the container and is securable thereto. The outer dimensions of the adjustment module are such that when an adjustment module or modules are disposed on the container, the unit formed thereby has outer dimensions that correspond to the inner dimensions of the launcher frame.

4 Claims, 3 Drawing Sheets

APPARATUS FOR ADAPTING A CONTAINER CONTAINING ARTILLERY ROCKETS TO A LAUNCHER APPARATUS FOR ARTILLERY ROCKETS

BACKGROUND OF THE INVENTION

The present invention relates to an apparatus for the adaptation of a container, which is adapted to contain a plurality of artillery rockets, to a launching apparatus for artillery rockets, wherein a box-like launcher frame is provided that is disposed on a support structure, especially a vehicle chassis, and is pivotable in elevation and azimuth, wherein at least one container, which has a right-angled cross section and contains a plurality of artillery rockets, is adapted to be inserted from one end into the launcher frame, and wherein in the past the outer dimensions of the container were adapted to the inner dimensions of the launcher frame.

A launcher apparatus for artillery rockets of this type disposed on a military vehicle is known, for example, from U.S. Pat. No. 5,461,961. With this known launcher apparatus, the containers, which contain the artillery rockets, must be adapted precisely to the inner dimensions of the launcher frame. This means that if artillery rockets or guided missiles of a different type are to be fired, the launcher apparatus must be appropriately adapted, which represents a considerable expense.

It is therefore an object of the present invention to provide an apparatus for the adaptation of a container, which is adapted to contain a plurality of artillery rockets, to a launcher apparatus of the aforementioned general type for artillery rockets, wherein such an apparatus, without alteration of the launcher apparatus, makes it possible to fire artillery rockets of a different type that are disposed in a container having other outer dimensions.

BRIEF DESCRIPTION OF THE DRAWINGS

This object, and other objects and advantages of the present invention, will appear more clearly from the following specification in conjunction with the following schematic drawings, in which.

SUMMARY OF THE INVENTION

The resolution of the aforementioned object is realized pursuant to the present invention in that for a container having outer dimensions that are smaller than the inner dimensions of the launcher frame, there is disposed on the upper side and/or the underside of the container a respective adjustment module in the form of an essentially rectangular flat panel that can be secured to the container, with the outer dimensions of the adjustment module or modules being such that when they are disposed upon the container, the outer dimensions of the thus formed unit, composed of the container and the adjustment module or modules, correspond to the inner dimensions of the launcher frame.

The basic concept of the present invention is that where the outer dimensions of a container that is to be used deviate from the inner dimensions of a launcher frame, it is possible to dispose on the upper side and/or the underside of the container a respective adjustment module that is embodied in such a way that after one or two adjustment modules are placed and secured upon the container, the container has precisely the outer dimensions that make it possible to insert it into the launcher frame and secure it there. In this connection, it has been shown to be expedient to dispose on the outer sides of the adjustment modules, in other words on the upper side of the upper adjustment module and the underside of the lower adjustment module, securement devices that on the one hand are necessary in order to mount and transport the container, and on the other hand are necessary for securing the container in the launcher frame. The adjustment modules thus form a weapon interface that makes it possible, without altering the mechanical interface of the launcher apparatus, to use other artillery rockets or guided missiles.

An adjustment module placed upon the upper side of the container can be embodied as a transport module that is provided on its outer side with at least one support or suspension device that is designed for the transport of the container.

An adjustment module placed upon the underside of the container can be embodied as a locking module that is provided on its outer side with securement devices for securing the container in the launcher frame.

Further specific features of the present invention will be described in detail subsequently.

DESCRIPTION OF PREFERRED EMBODIMENTS

Figure 1:
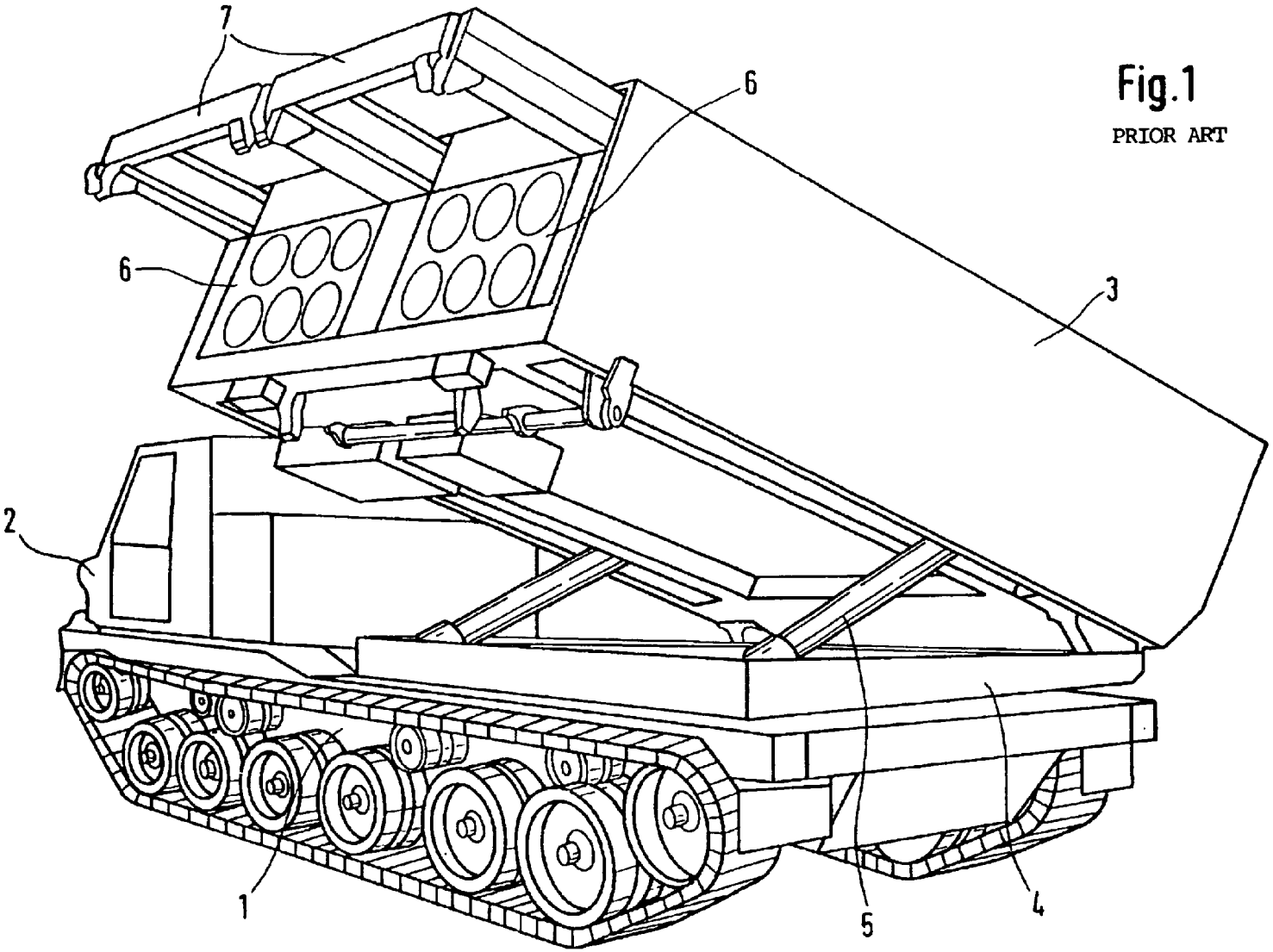
Fig. 1 PRIOR ART
FIG. 1 shows a perspective illustration at an angle from behind onto a military vehicle having a launcher apparatus for artillery rockets.

Referring now to the drawings in detail, FIG. 1 shows a military vehicle having a vehicle chassis 1, on which is disposed a cab 2, and also having a launcher apparatus for artillery rockets, with the apparatus being provided with a launcher frame 3 for accommodating the rockets. The launcher frame 3 is disposed on an upper carriage or mount 4 in such a way that it is pivotable in elevation. The upper mount 4 is mounted on the vehicle chassis 1 in such a way that it is pivotable in azimuth by means of a non-illustrated intermediate frame and a turntable. The pivoting movement in elevation is effected by an electrically driven elevated spindle or screw 5 that is disposed between the upper mount 4 and the launcher frame 3. Inserted into the box-like launcher frame 3, from the ends, are two containers 6 that can each accommodate six artillery rockets. The loading of the launcher frame 3 is carried out with hoisting means that each have two support arms 7 on which, in a manner not expressly illustrated, are disposed hoisting units.

Figure 2:
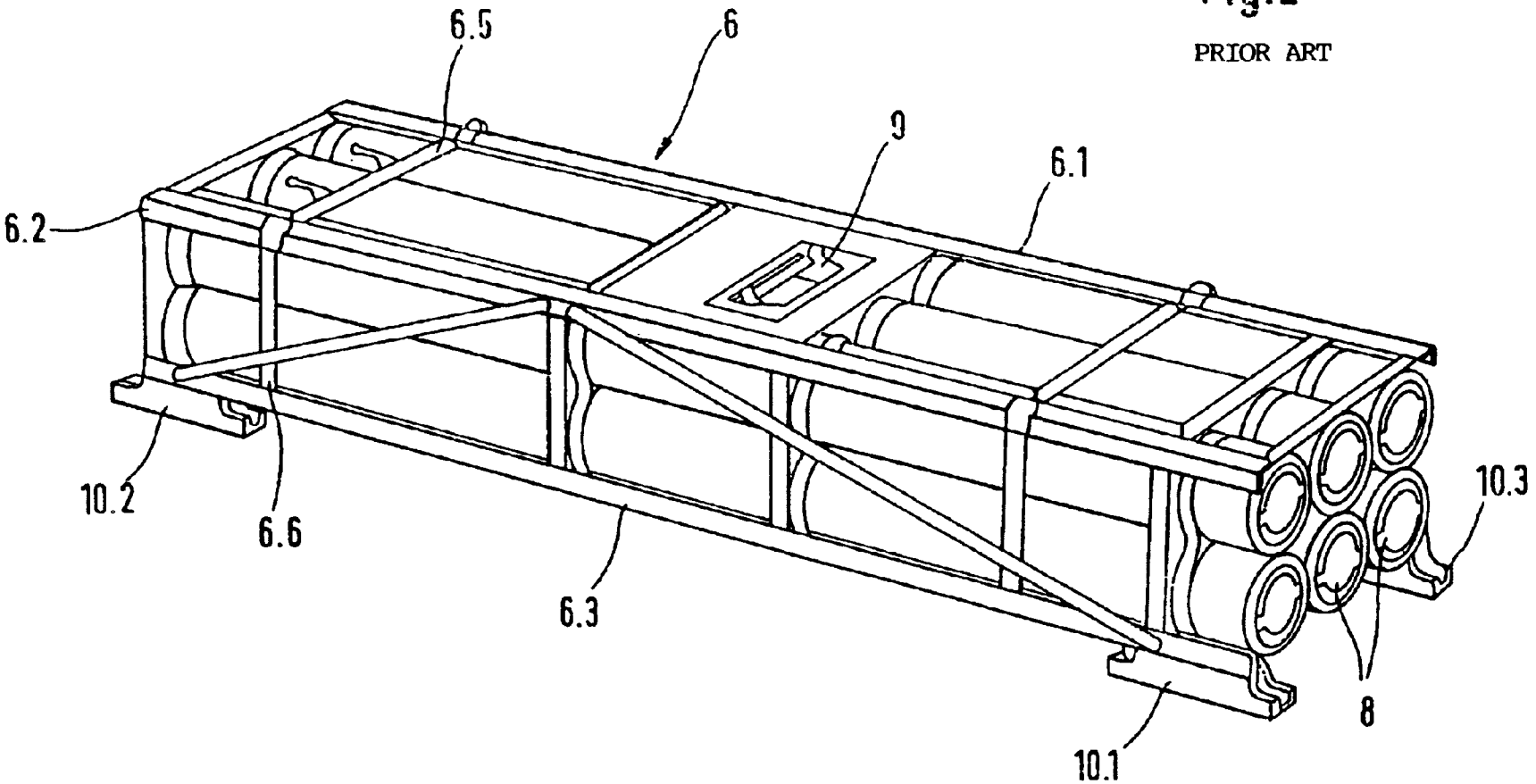
Fig.2 PRIOR ART
FIG. 2 shows a perspective illustration of a conventional container, which contains six artillery rockets, for discharge from a launcher apparatus as shown in FIG. 1.

Illustrated in FIG. 2 is a conventional container 6 that can be inserted into the launcher apparatus of FIG. 1. The container is frame-like, and is comprised of longitudinal and transverse members. Visible in FIG. 2 are the longitudinal members 6.1, 6.2 and 6.3, as well as transverse members that extend in the horizontal and vertical directions, two of which, by way of example, are provided with the reference numerals 6.5 and 6.6.

Disposed in the container 6 are six artillery rockets 8. On the upper side of the container 6 there is disposed a securement device 9 for the transport of the container, and disposed on the underside are securement devices 10.1, 10.2 and 10.3 for securing the container 6 within the launcher frame 3.

Figure 3:
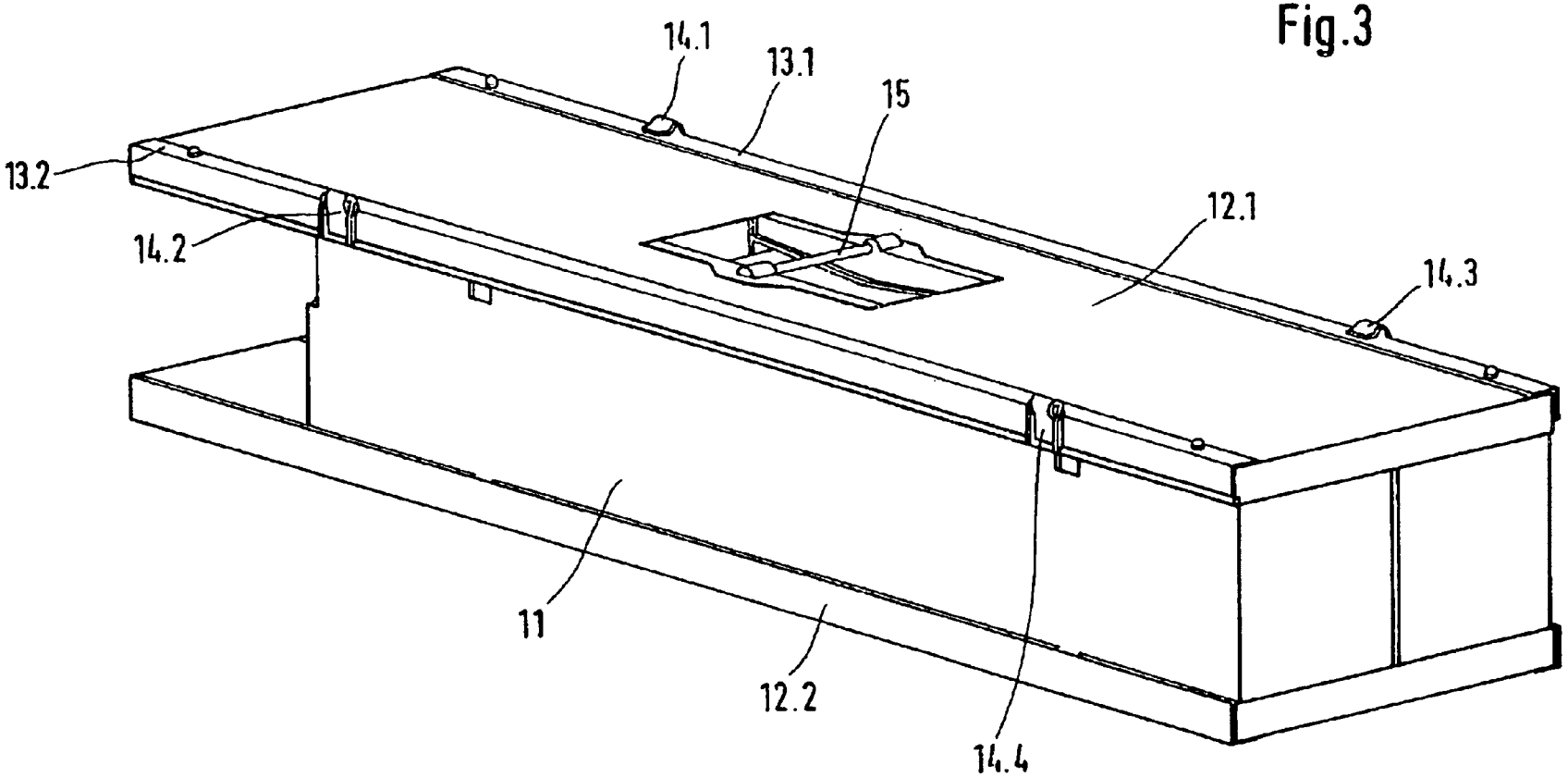
FIG. 3 shows a perspective illustration of a container having different dimensions than those of the conventional container and being provided with adaptation or adjustment modules for the discharge from a launcher apparatus as shown in FIG. 1.

FIG. 3 shows a container 11 that in a non-illustrated manner can contain a plurality of artillery rockets, and the outer dimensions of which are smaller than the inner dimensions of the launcher frame 3, so that this container cannot be inserted into the launcher frame 3 and secured there. To achieve this, there is disposed on the upper side of the container 11 an adjustment module 12.1, and on the underside of the container 11 an adjustment module 12.2. The length, width and thickness of each of the two adjustment modules 12.1 and 12.2 are dimensioned in such a way that the dimensions of the length, width and height of the unit composed of the container 11 and the two adjustment modules 12.1 and 12.2 correspond precisely to the corresponding inner dimensions of the launcher frame 3, thus enabling insertion into the launcher frame. The adjustment modules 12.1 and 12.2 are embodied as flat plates or panels of aluminum or steel, and are reinforced by longitudinal rails 13.1 and 13.2. The securement of the adjustment modules 12.1 and 12.2 to the container 11 is effected via non-illustrated securement devices.

Disposed on the upper side of the adjustment module 12.1, which is embodied as a transport module, is a support or suspension device 15, for the suspension of the container on a hoisting unit, as well as collapsible or pivotable transport hooks or loops 14.1, 14.2, 14.3 and 14.4. Disposed on the underside of the adjustment module 12.2, which is embodied as a locking module, are non-illustrated securement devices for the securement within the launcher frame 3.

The specification incorporates by reference the disclosure of German priority document 202 14 679.0 filed Sep. 23, 2002.

The present invention is, of course, in no way restricted to the specific disclosure of the specification and drawings, but also encompasses any modifications within the scope of the appended claims.

What is claimed is:

1. A rocket launcher artillery container adjustment module, for use with a box-like launcher frame disposed on a support structure and pivotable in elevation and azimuth, and having at least one artillery container having a right-angled cross-section and a plurality of artillery rockets insertable from one end into said box-like launcher frame comprising:

at least one essentially rectangular flat panel adjustment module disposable and securable on at least one of an upper side and an underside of an artillery container, and wherein outer dimensions of said at least one adjustment module are such that when said at least one adjustment module is disposed on said rocket launcher artillery container the unit formed thereby has outer dimensions that correspond fittingly to the inner dimensions of said box-like launcher frame.

2. An apparatus according to claim 1, wherein a flat panel adjustment module placed upon an upper side of said container is embodied as a transport module that is provided on an outer side thereof with at least one suspension device for a transport of said artillery container.

3. An apparatus according to claim 2, wherein a flat panel adjustment module placed upon an underside of said artillery container is embodied as a locking module that is provided on an outer side thereof with securement devices for securing said container in said box-like launcher frame.

4. An apparatus according to claim 2, wherein edge portions of at least one flat panel adjustment module are provided with transport hooks for securement of said artillery container during transport thereof.

* * * * *